United States Patent [19]

Ten Broeke et al.

[11] 4,205,826

[45] Jun. 3, 1980

[54] LIFTING AND SUPPORTING APPARATUS FOR A TOWER CRANE

[75] Inventors: Klaas E. Ten Broeke, Darien, Conn.; Manfred R. Kohler, Peekskill, N.Y.

[73] Assignee: American Pecco Corporation, Millwood, N.Y.

[21] Appl. No.: 960,459

[22] Filed: Nov. 13, 1978

[51] Int. Cl.[2] ..... B66F 7/14

[52] U.S. Cl. ..... 254/89 R; 254/105

[58] Field of Search ..... 254/89 R, 89 H, 105; 52/122–123, 126, 40, 745

[56] References Cited

U.S. PATENT DOCUMENTS

| | | | |
|---|---|---|---|
| 2,686,420 | 8/1954 | Yontz | 254/89 R X |
| 3,053,015 | 9/1962 | Graham | 254/89 R X |
| 3,207,475 | 9/1965 | Johansson et al. | 254/105 |

*Primary Examiner*—Robert C. Watson

*Attorney, Agent, or Firm*—Owen, Wickersham & Erickson

[57] ABSTRACT

A method and apparatus for lifting a tower crane, and for supporting the tower crane when lifted, utilizes the existing structure of the tower's mast sections for connection of lifting and supporting apparatus. Hydraulic jacks lift threaded lifting rods, which extend down to a pair of lifting yokes by means of adjustable nuts positioned to engage lifting surfaces of the jacks from above. At the top of the stroke of the jack, a second set of nuts are spun down the threaded rods to a position engaging a stationary support surface from above, so that the jacks can then be lowered and the first set of nuts can be spun down and returned to their original position. A third set of nuts is positioned near the bottoms of the rods to provide a means for supporting the lifting yokes. At the bottom end of the tower, at the lowermost mast section, where there are no bolts in the mast connecting sleeves, threaded rods with adjustable nuts enable the attainment of the precise desired height for the tower crane without the use of any specially fitted mast sections or attachments. Such control of the tower's height is necessary to locate a strong area of the tower, i.e. a location where struts meet the corner verticals, at a floor level so that side loading on the tower crane can be adequately accommodated.

11 Claims, 3 Drawing Figures

LIFTING AND SUPPORTING APPARATUS FOR A TOWER CRANE

BACKGROUND OF THE INVENTION

The invention relates to tower cranes, and more particularly to improved lifting and supporting apparatus for such a crane, and an associated method for lifting and supporting the crane.

Tower cranes have been used increasingly in recent years, particularly for the construction of reinforced concrete buildings. Some are free-standing, but the type of tower crane to which this invention relates is positioned within the building under construction, supported on building structure, usually passing through aligned floor slab openings created for this purpose. The tower of the tower crane is usually supported from one floor, extending upward through aligned openings in all completed upper floors.

As construction of the building progresses, the floors approach the boom of the crane, necessitating the raising of the boom and tower to a higher elevation.

For lifting the tower, one system previously in common use employed a hydraulic cylinder connected to a specially equipped lower mast section, with an additional cross piece or traverse connected to the cylinder and engaged in a pair of opposed ladder-like columns extending from the lower floors to the top of the building alongside the tower, within the shaft of floor openings. Dogs of this lifting structure would engage on rungs or slots of these ladder devices, moving up the ladders and engaging new slots as the lifting cylinder was actuated. Since the ladder devices extended through the entire height of the building, they served as supporting means for the working crane, as well as being involved in the lifting operation when raising of the crane was required.

In another lifting system which has been widely used, jacks were positioned on a floor of the building structure, with smooth lifting rods depending downwardly from the jacks to a connecting device engagable with a specially equipped mast section. A device associated with the jacks and having teeth would grasp each rod for the lifting stroke. The specially equipped mast section, normally located at the bottom of the tower crane, had holes for receiving the connecting device, which extended laterally through the mast. The tower crane was supported entirely by the rods and connecting device while being lifted by a series of jacking strokes.

For supporting the crane after it was lifted to the new elevation, this latter system utilized I-beams inserted horizontally through a mast section. The jacks lowered the crane a short distance, to rest the I-beam on a building floor.

Both these prior systems and methods for lifting and supporting a tower crane were effective, but required specially equipped mast sections and additional heavy equipment and were usually time consuming to make ready for a lifting operation. Also, the support systems for the working crane were inadequate in that they depended upon the position of the specially fitted mast section which was designed for the support function. It is always highly desirable to have a strong point of the tower, where diagonals meet horizontal and vertical members, at the level of the highest floor through which the tower extends, to accept side loading forces to hold the crane from tipping and to accept twisting forces induced by the boom. If the highest floor does not coincide with a strong point, but rather lies between two of them, the side loading and twisting forces on the tower can bend and buckle the unsupported stretches of vertical corner members in the tower. With some support systems, such positioning has been unavoidable because the spacing between floors is usually not the same as or an integral multiple of the spacing between the strong points of the mast sections. Therefore, it has been necessary to strengthen the vertical mast members or use some other arrangement to distribute the side loading over a larger area or to the strong points.

Another shortcoming of most prior tower lifting systems were that they were required to be left with one particular crane during the entire construction operation. It was impossible to utilize them for multiple cranes at the same construction site.

SUMMARY OF THE INVENTION

The tower crane lifting and supporting method and system of the present invention overcomes the above difficulties encountered with prior systems by providing lifting apparatus which is versatile, being movable from crane to crane on a construction job for lifting a plurality of cranes at different times, and which utilizes lifting yokes which are not part of the mast structure but are portable and are readily engagable on pre-existing structure associated with a typical mast section. No modification of mast structure is required for either the lifting or the supporting system. The yokes include spaced apart open-topped sleeves engageable around the bolts and nuts that extend from the typical connecting sleeves at the bottom of one mast section and the top of the mast section immediately below. Therefore no fasteners are required to connect the yokes to the masts. Hydraulic jacks are utilized for the lifting, as in typical lifting systems, but threaded lifting rods are utilized to connect the jacks with the lifting yokes below. Nuts on the threaded rods just above lifting surfaces of the jacks accept the lifting force and transmit it to the rods and the lifting yokes to move the tower upwardly. When the jacks are at the top of their stroke, a second set of nuts are lowered on the rods into engagement with a fixed supporting surface. The tower crane is suspended temporarily by means of these second nuts and the fixed supporting surface while the jacks are returned to the unextended position and the upper nuts are lowered back into engagement with the lifting surfaces of the jacks. This cycle is repeated until the desired new level for the tower is reached. Such threaded rod and jack apparatus has been used previously for some types of jacking and lifting operations, but not for lifting of tower cranes.

The method by which the tower crane is supported while working also involves the connecting sleeves which typically exist at the bottom and top of a mast section. At the bottom of the bottom mast section, there are no bolts passing through these connecting sleeves, and by the method and system of the invention, threaded rods are passed through these sleeves and extend upwardly to a support beam which rests on a lower floor or other building structure. The threaded rods are in opposed positions on the tower, with two opposed pairs preferably being provided. Nuts are secured on the threaded rods, below the sleeves at the bottom of the mast section and above the supporting surface of the support beam. By this arrangement, the desired height of the crane can be precisely attained, simply by raising the tower to the desired level with the lifting apparatus, then installing the threaded rods and nuts.

Accordingly, in one embodiment of the invention a lifting and supporting system for a tower crane of the type described above, wherein the vertical connecting sleeves of the stacked mast sections are utilized, comprises jacking means supported on the building structure adjacent to the tower, lifting rod means connected to the jacking means and extending downwardly, a pair of lifting yokes, each having means for engaging the vertical mast-connecting sleeve and bolts from below, and means associated with the bottom vertical sleeves of the bottom mast section for supporting the weight of the tower crane from lower building structure, after the tower has been lifted. By this system the tower crane may be raised and supported conveniently and efficiently, without the use of specially fitted or modified mast sections.

It is therefore among the objects of the invention to provide an improved method and apparatus for lifting a tower crane and supporting it after it has been lifted, without the need for modification of mast sections or laborious procedures for readying the tower for lifting or supporting the tower against side loading at its new level. A related object is to provide for utilizing one set of lifting apparatus for a number of cranes. These and other objects, advantages and features of the invention will be apparent from the following description of a preferred embodiment, taken in conjunction with the appended claims.

DESCRIPTION OF A PREFERRED EMBODIMENT

Figures 1, 3:
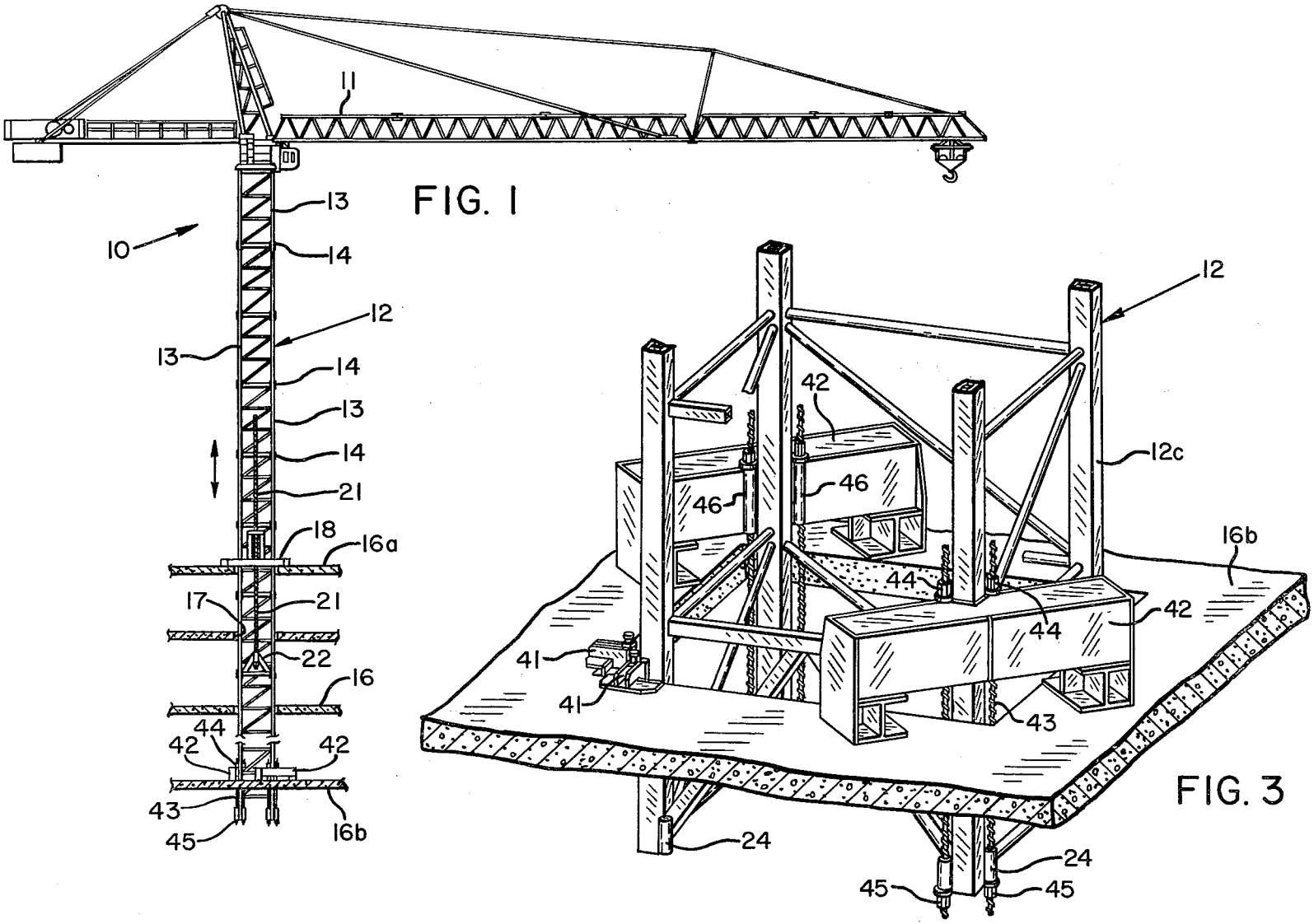
FIG. 1 is an elevation view of a typical tower crane as it is positioned in a building structure, and indicating some of the apparatus of the invention.
FIG. 3 is a perspective view illustrating the tower supporting apparatus of the invention.

In the drawings, FIG. 1 shows a tower crane 10 having a boom 11 and a tower 12 which is made up of a plurality of stacked mast sections 13. The mast sections are interconneted at points 14, which include bolt and sleeve connections shown in greater detail in FIG. 2. The tower 12 of the crane is supported by the structure of the building under construction, as by floors 16 of the building, portions of which are illustrated in FIG. 1. As is typical of this type of building-supported tower crane, floor slab openings 17 are formed around the tower 12 as the building rises. These openings fit around the tower with little clearance, and corner wedges (not illustrated in FIG. 1) tightly hold the tower in place except when the crane is being raised. By this arrangement, upper floors, particularly the top floor **16*a*, accept most of the side (tipping) loading and twisting loading on the tower. A lower floor 16*b*** supports the weight of the tower crane, with the tower suspended therefrom according to principles of the invention, further illustrated in FIG. 3.

Figure 2:
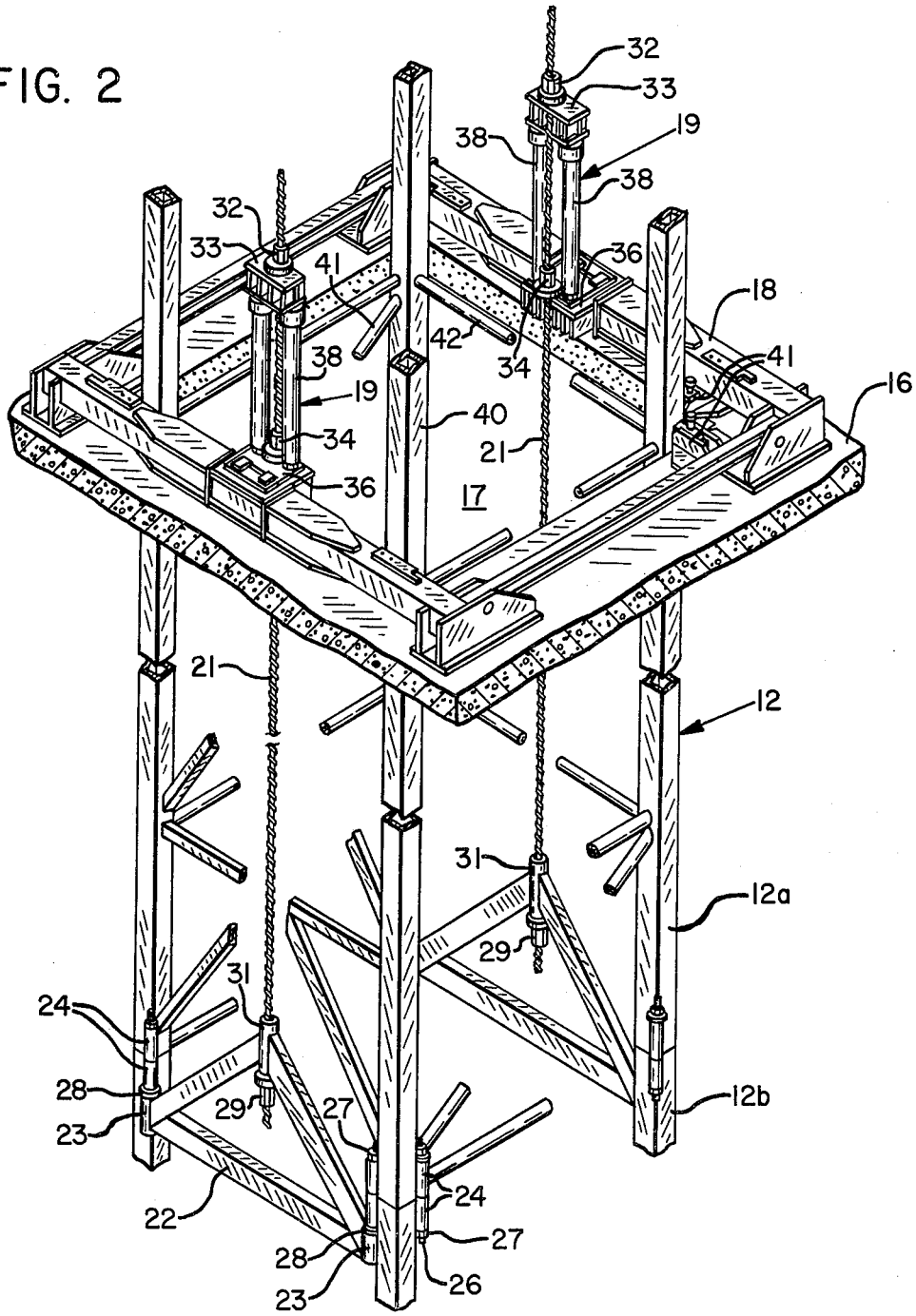
FIG. 2 is a perspective view illustrating the tower crane lifting apparatus of the invention.

FIGS. 1 and 2 indicate tower lifting apparatus according to the invention, including a jack support beam 18 resting on one of the upper floors 16 and extending around the opening 17 and the tower 12. Jacking means 19, preferably hydraulic jacks, extend upwardly from the support beam 18, being connected to a pair of high-strength threaded lifting rods 21. These rods extend downwardly to a connection with lifting yokes 22. As illustrated in FIG. 2, these yokes are preferably triangular and include a pair of open-topped sleeves 23 spaced apart at the spacing of interconnection sleeves 24 which are affixed to adjacent mast sections **12*a* and 12*b* of the tower 12 and are typical of this type tower crane. The vertical sleeves 24 are joined by bolts 26 and nuts 27, with doughnut washers 28 typically positioned between the nut and the sleeve 24. It is around these downwardly extending bolts and nuts that the yoke sleeves are positioned for lifting. The yoke sleeves are sized to fit over the nuts and to engage against the doughnut washers 28. No fasteners are required to connect the yokes 22 to the tower 12. The yokes are maintained in position by the nuts 27, and the lifting force of each yoke sleeve 23 is exerted against the mast interconnection sleeves 24 via the doughnut washers 28**.

The threaded lifting rods 21 are preferably connected to the triangular lifting yokes 22 by means of nuts 29 which engage a sleeve 31 of each lifting yoke from below as shown. Other types of connection between the yoke 22 and rod 21 may be used if desired, although the illustrated connection is preferred for convenience of assembly and disassembly and installation on the tower.

Up higher on the lifting rods 21, the hydraulic lifting jacks also interact with the rods by means of nuts threaded to the rods. First nuts 32 are positioned to engage a lifting surface 33 of each jack from above as shown, while second nuts 34 are positioned to engage a fixed support surface 36 of the jack support beam 18 during periods when the jacks 19 are returning to their unextended position following a lifting stroke. As explained above, the first nuts 32 transfer the lifting force to the rods 21 during the upstroke, and at the top of the stroke, the second nuts 34 are spun back down into engagement with the supporting surfaces 36 to temporarily hold the weight of the tower crane. Then the jacks are returned to the unextended position and the first nuts 32 are spun back down to the position shown in FIG. 2.

As indicated, the jacks 19 may each comprise a pair of hydraulic cylinders 38, vertically mounted on the jack support beam 18. Other types of limited-stroke jacking means may be used in place of the jacks 19 if desired.

Since the building floor (or other structure) provides horizontal restraint on the tower 12 of the crane, it is important that a strong point of the tower be coincident with one of the upper floors, preferably the top floor, as discussed above. This is illustrated in FIG. 2, where a strong point defined by intersection of vertical members 40, diagonal members 41 and horizontal members 42 is positioned at the level of the floor 16. As discussed earlier, corner wedges or plates 41 engage the tower tightly to brace it against tipping or side loading, as well as against twisting loading induced by the boom.

To assure that such a strong point can be located at the precise level of the desired floor, the supporting apparatus of FIG. 3 is utilized. This supporting apparatus according to the invention includes a pair of crane support beams 42 at opposite corners of the tower, resting on a lower floor **16*b*, and a pair of high-strength threaded support rods 43 extending down from each support beam to the bottom interconnection sleeves 24 at opposed corners of this lowermost mast section 12*c*. Since this is the lowermost mast section, there are no bolts passing through the sleeves 24, and they are available for this supporting purpose. Nuts 44 and 45 are positioned to bear down on the support beams 42 and to bear up against the mast sleeves 24 respectively. The upper nuts 44 preferably bear against the upper ends of sleeves 46 which are integral with the support beams 42. By means of this support system, the tower 12 can be positioned precisely as desired by the jacks 19, and the threaded crane support rods 43 may then be installed, and the nuts tightened, to hold the crane at this level until it is again necessary to raise it. The same type threaded rod may be used for the support rods 43 as is used for the lifting rods 21**.

It is apparent that the described lifting and supporting apparatus for a tower crane is more efficient, less time consuming and simpler in structure than previously used methods and apparatus. One efficient feature of the lifting apparatus of the invention is that of increased versatility in that once the crane is supported at the desired level, the lifting apparatus may be quite easily moved to another tower crane at the same job site, and may be used to lift a plurality of such cranes in sequence. Also, additional tower sections may be added as needed. Since no special climbing sections are required, additional tower sections can be added directly under the lowermost section after the crane has been lifted. In addition, the lifting system has the capability of making very high climbs since the climb is limited only by the length of the lifting rods, which may be long or may be spliced to make long rods.

The above described preferred embodiment provides a lifting and supporting method and apparatus for a building-supported type tower crane which is much superior to previous such apparatus and methods, principally by the efficient utilization of the existing mast section structure of the tower. Various other embodiments and variations to this preferred embodiment will be apparent to those skilled in the art and may be made without departing from the spirit and scope of the following claims.

We claim:

1. A method of lifting a tower crane extending vertically through openings in floor structure of a building under construction, comprising:

providing jacking means supported by the floor structure, adjacent to an opening;

installing a pair of lifting yokes, each having spaced apart connecting sleeves, on the tower crane by inserting the open upper ends of the connecting sleeves over the bottom ends of vertically oriented bolts which extend through sleeves affixed to adjacent mast sections of the tower to connect the mast sections together;

providing a pair of lifting rods, one connected to each yoke and extending vertically upwardly to the jacking means;

raising the tower crane by activating the jacking means to pull the lifting rods upwardly; and continuing to raise the tower crane until a new desired position is established.

2. The method of claim 1 which further includes, following the establishing of the new position, supporting the tower of the crane by its lower end, by passing threaded rods through the unused bottom connecting sleeves of the bottom mast section, with nuts on the threaded rods below the sleeves, hanging the rods on support means resting on floor structure of the building, with nuts on the threaded rods above the support means, and adjusting and tightening the nuts to maintain the new position.

3. The method of claim 1 wherein said lifting rods are threaded and said raising step includes moving the threaded rods upwardly in an upward stroke of the jacking means by means of lifting nuts positioned on the rods above the point of connection to the jacking means, then when the jacking means is fully extended at the top of its stroke, spinning holding nuts downwardly to rest on a fixed platform associated with the base of the jacking means, resting the weight of the tower crane on the holding nuts, lowering the jacking means to its unextended position, spinning the lifting nuts down to their former position on the jacking means, and repeating the cycle until the new desired position of the tower crane is reached.

4. A lifting system for a tower crane of the type having a tower comprised of a series of stacked mast sections connected together by vertical sleeves at top and bottom of each mast section and bolts passing through adjacent sleeves, said tower adapted to be supported against horizontal movement by internal structure of a building under construction, comprising:

a jack support beam positioned to rest on structure of the building, about an opening through which the tower crane extends;

jacking means supported on the jack support beam;

lifting rods connected to the jacking means and extending downwardly; and a lifting yoke connected to and suspended by the lower end of each lifting rod, each yoke having a pair of open-topped sleeves spaced apart at the spacing of the vertical mast connection sleeves and bolts and adapted to fit over the bolts from the underside;

whereby the lifting system may be readily connected to lift the tower crane and is readily disconnected, without requiring any tower-engaging fasteners nor any specially-fitted mast sections.

5. The lifting system of claim 4 which further includes means associated with the bottom vertical sleeves of the bottom mast section for supporting the weight of the tower crane from lower building structure, after the tower has been lifted.

6. The lifting system of claim 5 wherein said supporting means comprises beam means supported by said lower building structure, and at least two threaded rods supported by said beam means on opposite sides of the tower and hanging downwardly and passing through bottom vertical sleeves of the bottom mast section, with nuts on the threaded rod engaging the beam means from above and engaging the vertical sleeves from below, whereby the height of the tower may be precisely controlled.

7. The lifting system of claim 4 wherein the lifting rods are threaded and include nuts, a first nut of each rod being positioned to engage a lifting surface of the jacking means from above and a second positioned to engage a stationary support surface of the jack support beam from above, said jacking means having a limited stroke, whereby the tower may be raised by the jacking means via said first nuts, through the stroke of the jacking means, then the second nuts may be spun down and returned to the stationary support surface to support the tower while the jacking means is lowered and the first nuts are spun down and returned to the lifting surface of the jacking means, and the cycle may be repeated until the desired position is reached.

8. The lifting system of claim 7 wherein a third nut is positioned on each threaded lifting rod to engage the lifting yoke from below, providing the connection between the lifting yoke and the lower end of the lifting rod.

9. The lifting system of claim 4 wherein said lifting yoke comprises a triangular structure having means for connection to the lifting rod at its upper end and having said open-topped sleeves at its lower, outer extremities.

10. A lifting and supporting apparatus for a tower crane, of the type having a tower comprised of a series of stacked mast sections connected together by vertical sleeves at top and bottom of each mast section and bolts passing through adjacent sleeves, said tower adapted to be supported against horizontal movement by internal structure of a building under construction, said lifting and supporting apparatus utilizing the vertical sleeves of the stacked mast sections, comprising:

jacking means supported on the building structure adjacent to the tower;

lifting rod means connected to the jacking means and extending downwardly;

a pair of lifting yokes, each having means for engaging the vertical mast-connecting sleeves and bolts from below; and means associated with the bottom vertical sleeves of the bottom mast section for supporting the weight of the tower crane from lower building structure, after the tower has been lifted;

whereby the tower crane may be raised and supported conveniently and efficiently, without the use of specially fitted mast sections.

11. The apparatus of claim 10 wherein said supporting means comprises beam means supported by said lower building structure, and at least two threaded rods supported by said beam means on opposite sides of the tower and hanging downwardly and passing through bottom vertical sleeves of the bottom mast section, with nuts on the threaded rod engaging the beam means from above and engaging the vertical sleeves from below, whereby the height of the tower may be precisely controlled.

* * * * *